US007827927B2

(12) United States Patent
Kivi

(10) Patent No.: US 7,827,927 B2
(45) Date of Patent: Nov. 9, 2010

(54) ANCHORING SYSTEM FOR WATERCRAFT VESSELS

(75) Inventor: Craig Kivi, 1248 Louise St., Pinckney, MI (US) 48169

(73) Assignee: Craig Kivi, Pinckney, MI (US)

( * ) Notice: Subject to any disclaimer, the term of this patent is extended or adjusted under 35 U.S.C. 154(b) by 35 days.

(21) Appl. No.: 12/399,324

(22) Filed: Mar. 6, 2009

(65) Prior Publication Data

US 2009/0223428 A1 Sep. 10, 2009

Related U.S. Application Data

(60) Provisional application No. 61/034,249, filed on Mar. 6, 2008.

(51) Int. Cl.
*B63B 21/24* (2006.01)

(52) U.S. Cl. ..... 114/294; 52/155

(58) Field of Classification Search ..... 114/294, 114/295, 301, 304; 52/155
See application file for complete search history.

(56) References Cited

U.S. PATENT DOCUMENTS

| | | | |
|---|---|---|---|
| 517,556 | A | 4/1894 | Ross |
| 686,597 | A | 11/1901 | Debose |
| 2,536,908 | A | 1/1951 | Chadwick |
| 2,907,294 | A | 10/1959 | Lawler |
| 3,050,880 | A | 8/1962 | Cushing, Sr. |
| 3,238,912 | A | 3/1966 | Perlick |
| 3,626,887 | A | 12/1971 | Schutt et al. |
| 3,638,257 | A | 2/1972 | Ernst |
| 3,693,569 | A | 9/1972 | Chauvin |
| 4,070,978 | A | 1/1978 | Virgilio |
| 4,254,730 | A | 3/1981 | Crenshaw |
| 4,377,123 | A | 3/1983 | Jackson |
| 6,041,730 | A | 3/2000 | Oliverio et al. |
| 6,058,871 | A | 5/2000 | Tanner |
| 6,092,484 | A | 7/2000 | Babin et al. |
| 6,220,197 | B1 | 4/2001 | Pohlman |
| 6,273,016 | B1 | 8/2001 | Gibbs |
| 7,270,072 | B2 | 9/2007 | Waldrop |
| 7,270,073 | B1 | 9/2007 | Waldrop |

*Primary Examiner*—Lars A Olson
(74) *Attorney, Agent, or Firm*—Honigman Miller Schwartz and Cohn LLP; Fernando Alberdi; Jonathan P. O'Brien

(57) ABSTRACT

An anchoring system for a watercraft vessel, the anchoring system including an anchor bracket configured to be mountable on the watercraft vessel; a sleeve attached to the anchor bracket, the sleeve having an aperture disposed longitudinally therethrough; a sliding tube inserted through the sleeve, the sliding tube being at least partially hollow and having a first end and a second end, a rod having a first end disposed within a sliding tube lumen and a second end having a floor contacting tip; the floor contacting tip operable to penetrate the bottom of a creek, lake, river or ocean flat and a retraction member connected to the rod. The retraction member is configured to retract the rod into the sliding tube and retract the sliding tube through the sleeve.

20 Claims, 5 Drawing Sheets

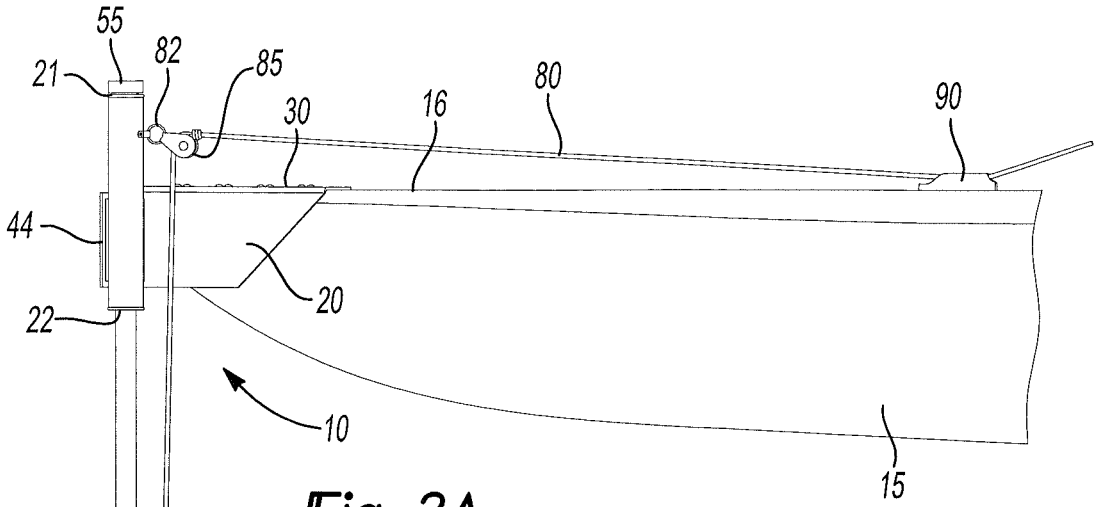
Fig-2A
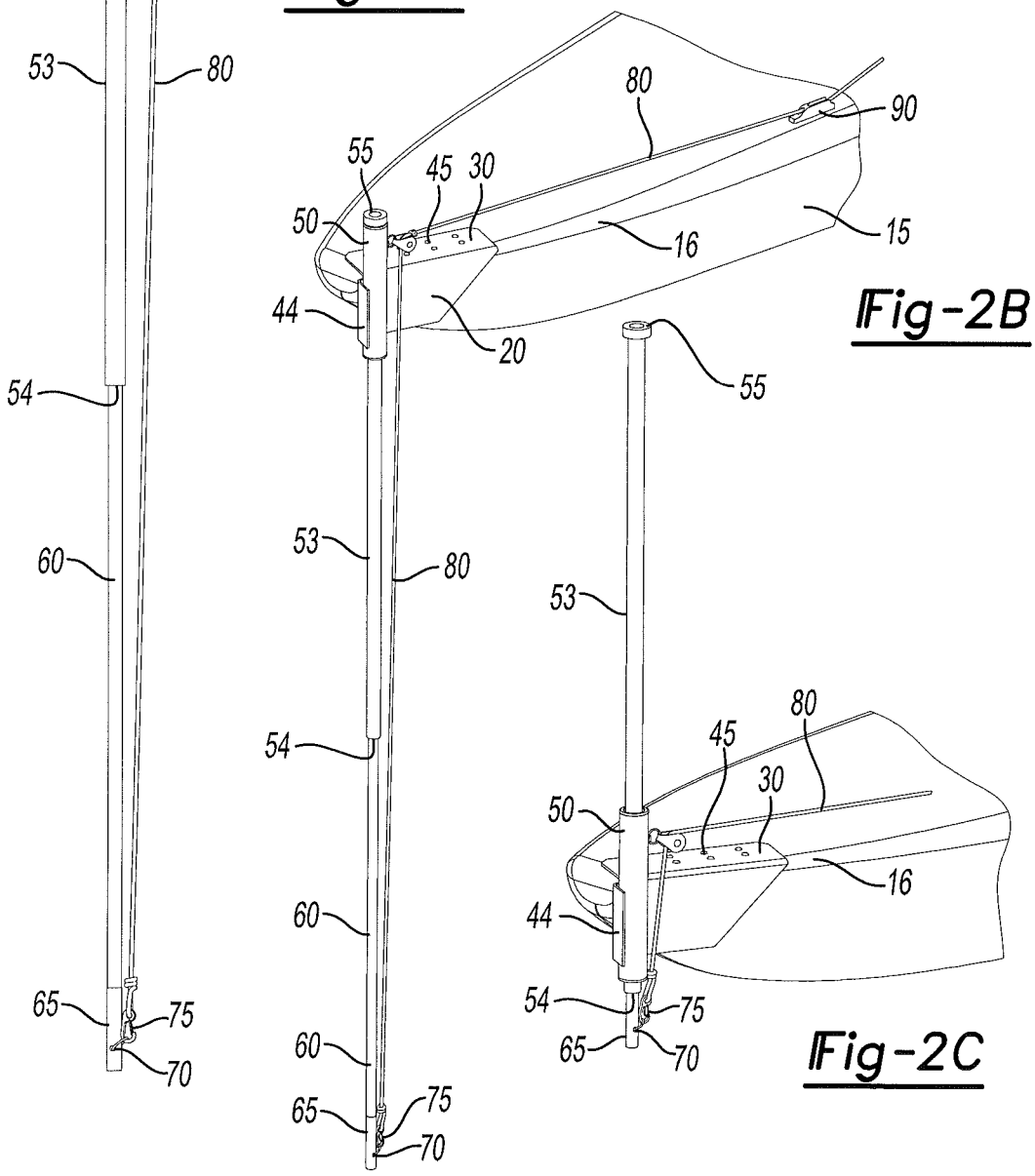
Fig-2B
Fig-2C

ANCHORING SYSTEM FOR WATERCRAFT VESSELS

CROSS-REFERENCE TO RELATED APPLICATIONS

This application claims the benefit of U.S. Provisional Application No. 61/034,249, filed on Mar. 6, 2008. The disclosure of the above application is incorporated herein by reference.

FIELD

The present technology relates to a watercraft vessel anchoring system for use in stationary or moderately flowing bodies of water.

BACKGROUND

The statements in this section merely provide background information related to the present technology and may not constitute prior art.

The use of watercraft vessels for fishing in rivers and other shallow bodies of water have traditionally involved small fiberglass and aluminum rowboats. In all of these watercraft, a light, safe and readily deployable anchor has been desirable. In recent times, there has been an explosion of canoe and kayak usage on rivers, lakes, salt water flats and estuaries due to their superior maneuverability and stealthliness. Kayaks and canoes offer single operator use in exploring both fast and slow moving currents in a wide array of shallow water formations.

The significant advantage of using kayaks and canoes over other watercraft lies primarily in their ability to stalk feeding fish in their natural feeding environment. Although a recent phenomenon in the sports fishing industry, standing up in a kayak or canoe offers the angler unsurpassed advantage when compared to spotting fish while standing in these shallow water formations. Concomitant to the ability of spotting fish is the necessity to anchor the watercraft at a distance from the spotted fish by deploying and retrieving an anchor motionlessly and as quietly as possible while standing and/or sitting in the watercraft. Also, there are many designated areas that restrict or even prohibit the use of motors to propel the watercraft vessel. In these situations, kayaks, canoes and other "flat bottomed" drift boats offer the angler the best opportunity to catch fish. Other small boats often require 10 or 12 inches of water to float without scraping bottom. To make the best use of a kayak or canoe for fishing shallow water, the operator will likely benefit from fishing in very shallow water both inland and in coastal areas.

However, with kayaks, canoes and other manually propelled vessels, the operator is typically required to paddle the vessel into position before fishing can commence. Stabilization and positioning of the vessel further requires the use of the paddles, which distinctly limits the ability of the fisherperson to utilize the fishing equipment in the vessel. For some forms of fishing, for example, fly fishing in a river system, the fly fisher requires both hands to participate in the casting and line retrieval. The only option for the fisherperson to fish in a stationary position is to exit the watercraft and tie the vessel to a stationary object or to hold on to the vessel while trying to cast and retrieve the fly line. Both situations are impractical and hinders the enjoyment of fishing in these shallow waters.

Anchors need to be snag-less in a river, particularly when there is debris or vegetable covered water bottoms. Anglers typically use chain or window weights, but these are incredibly noisy, scare fish dragging on the bottom and when they touch the boat and collect sediment, refuse and aquatic vegetation. Further, these anchors use friction to hold the boat in position, so they drag for a long time before actually stopping the small watercraft vessel, and sometimes they never stop it fully, which puts the angler out of position. Anchors perform differently in different depths and current speed and therefore are unpredictable. There is no way to get a sure anchor point in all of these conditions without using an anchor of significant weight. In light boats such as kayaks, canoes, inflatable pontoon boats and drift boats, this is unacceptable as it creates a lift and drop hardship, and can cause dangerous instability.

U.S. Pat. No. 6,220,197 to Pohlman describes a device for anchoring and operating a watercraft on a body of water. In order to operate the anchoring system, an anchoring system locking means is released requiring the release of a set screw and clamp. A pole is then placed in position and the operator must insert the locking means into a locking cup. The large diameter pole is then required to be driven into the ground. The entire process requires a plurality of steps, and requires the operator to position themselves on the edge of the vessel, creating a potential for instability. The deployment also requires a minimum of two hands and significant body movement to engage the various parts before the anchoring pole is locked into position thereby making this arrangement impossible to deploy in small watercraft vessels especially while standing up in these small unstable watercraft.

There however exists a need for an anchoring system that can be deployed simply, without excessive force or need to drive into the ground, and while the operator is seated or standing in the watercraft vessel without necessarily facing the anchor mechanism, or moving their upper body mass, to deploy or retrieve the anchoring system.

SUMMARY

The present technology and the anchoring system described herein, provides significant advantages over preexisting anchors currently known. For example, the anchoring system of the present technology provides the advantages of: ease and simplicity of installation and removal; ease of utilization by a single operator positioned in a standing or sitting position in the vessel; ease of removal of the anchoring system with respect to both of storage and transportation in both vehicle and kayak; light weight i.e. components weigh less than 20 pounds; installation or usage of the anchoring system with the vessel will not damage the vessel or necessarily require any structural modifications to the vessel; durable in fit, form and function, operable in all facets of marine and fresh water; easily cleaned, dries out quickly, will not mold or mildew; possesses safety features such as easily replaceable break-away spare parts.

Additional advantages the present technology and the anchoring system described herein over the preexisting anchors currently known include ultra-light; weighing a fraction of a standard anchor, silent; does not bang or scrape on the vessel or bottom, or make any significant noise when deployed or lifted, precise; drags minimally to a stop and has no oscillating rope slack, clean; doesn't hold dirt, mud, or vegetation, silt-less; doesn't create a plume of sand and silt when it hits the bottom, or drags on the bottom, snag-less; will not get caught on rocks, logs, vegetation or other debris, and ecological; doesn't damage river, lake bottoms, vegetation or aquatic life. The anchoring system of the present technology does not need to be driven into the ground. Moreover, the anchoring system of the present technology provides significant additional stability to the watercraft vessel in a front to back and side to side which cannot be realized with any rope and weight combination of the prior anchoring systems. An additional safety and convenience benefit is evident, that of allowing an operator of a vessel ease of getting in an out of a vessel in shallow water by stepping one foot out of the vessel onto the bottom and "pushing the vessel back" against and toward the deployed anchor system, thereby transforming the vessel into a more solid platform to push off and stand up. The reverse is also true in getting into the vessel.

Further areas of applicability will become apparent from the description provided herein. It should be understood that the description and specific examples are intended for purposes of illustration only and are not intended to limit the scope of the present technology.

DRAWINGS

The drawings described herein are for illustration purposes only and are not intended to limit the scope of the present technology in any way.

FIG. 1A. depicts a side elevation view of the anchoring system mounted to a kayak in accordance with the present technology.

FIG. 2A depicts a partial side elevation view of an anchoring system mounted to a kayak having a single bracket mounted to the side of the watercraft vessel.

FIG. 2B depicts partial side elevation view of the watercraft vessel of FIG. 2A, wherein the anchoring system is in an elongated or deployed orientation in accordance with the present technology.

FIG. 2C depicts partial side elevation view of the watercraft vessel of FIG. 2B, wherein the anchoring system is in an resting or retracted orientation in accordance with the present technology.

DETAILED DESCRIPTION

Figure 1A:
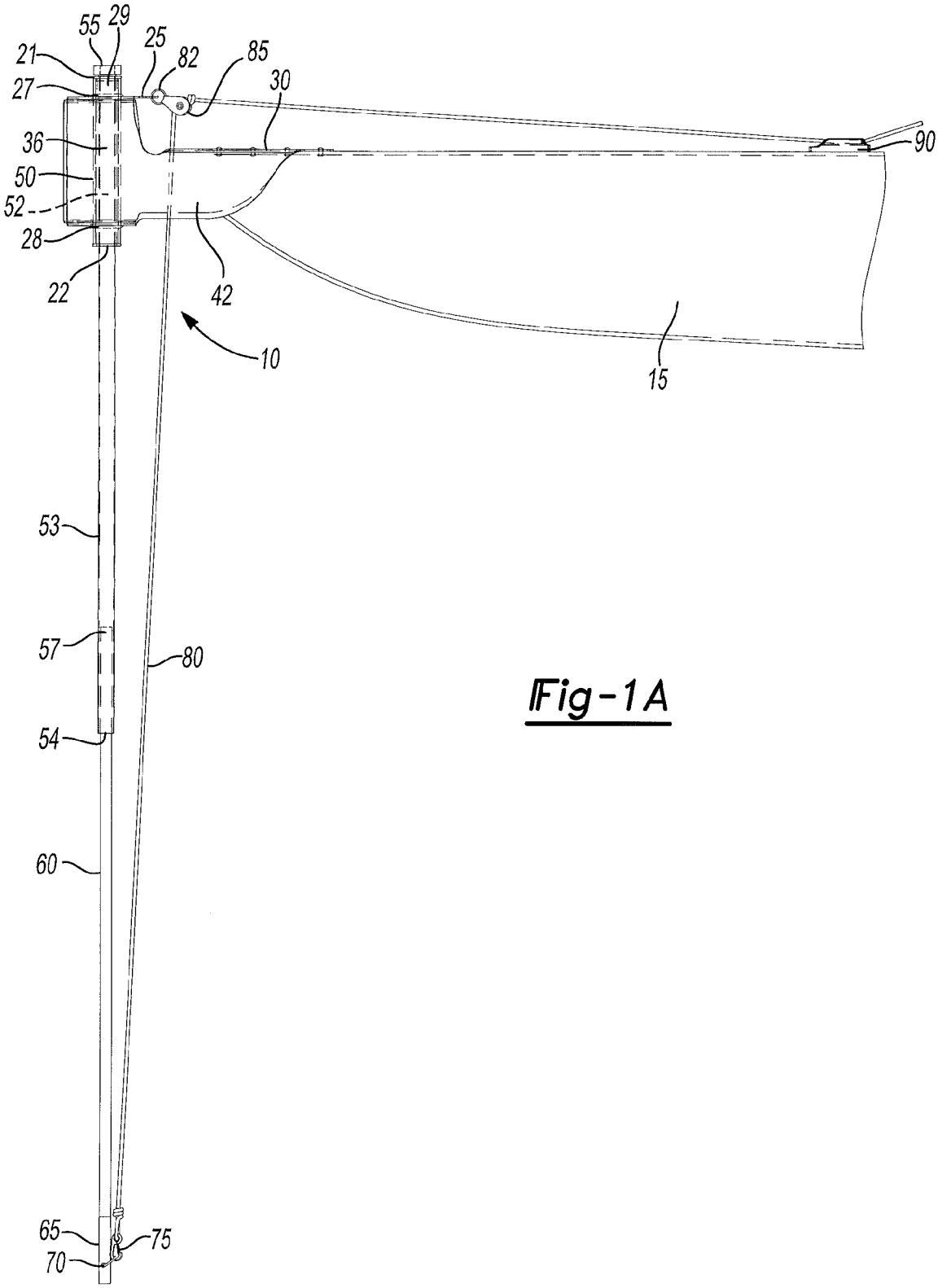
FIG. 1B depicts a partial side elevation view of the anchoring system in an elongated or deployed orientation in accordance with the present technology.
FIG. 1C depicts partial side elevation view of the watercraft vessel of FIG. 1B in a resting or retracted orientation in accordance with the present technology.
FIG. 1D depicts a partial top plan view of hinged brackets mounted to the front or bow of a watercraft vessel in accordance with the present technology.

The following description is merely exemplary in nature and is not intended to limit the present technology, application, or uses. It should be understood that throughout the drawings, corresponding reference numerals indicate like or corresponding parts and features.

The following definitions and non-limiting guidelines must be considered in reviewing the description of this invention set forth herein. The headings (such as "Introduction" and "Summary,") and sub-headings (such as "Compositions" and "Methods") used herein are intended only for general organization of topics within the disclosure of the invention, and are not intended to limit the disclosure of the invention or any aspect thereof. In particular, subject matter disclosed in the "Introduction" may include aspects of technology within the scope of the invention, and may not constitute a recitation of prior art. Subject matter disclosed in the "Summary" is not an exhaustive or complete disclosure of the entire scope of the invention or any embodiments thereof. Classification or discussion of a material within a section of this specification as having a particular utility (e.g., as being a "system") is made for convenience, and no inference should be drawn that the material must necessarily or solely function in accordance with its classification herein when it is used in any given component.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The citation of references herein does not constitute an admission that those references are prior art or have any relevance to the patentability of the invention disclosed herein. Any discussion of the content of references cited in the Introduction is intended merely to provide a general summary of assertions made by the authors of the references, and does not constitute an admission as to the accuracy of the content of such references. All references cited in the Description section of this specification are hereby incorporated by reference in their entirety.

The description and specific examples, while indicating embodiments of the invention, are intended for purposes of illustration only and are not intended to limit the scope of the invention. Moreover, recitation of multiple embodiments having stated features is not intended to exclude other embodiments having additional features, or other embodiments incorporating different combinations the stated of features. Specific Examples are provided for illustrative purposes of how to make and use the anchoring system and methods of using the invention and, unless explicitly stated otherwise, are not intended to be a representation that given embodiments of this invention have, or have not, been made or tested.

As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "about," when applied to the value for a parameter of a component or structural member or method of this invention, indicates that the calculation or the measurement of the value allows some slight imprecision without having a substantial effect on the performance or physical attributes of the anchoring system or method.

The term "a" as used herein means at least one.

As used herein, the word "include," and its variants, is intended to be non-limiting, such that recitation of items in a list is not to the exclusion of other like items that may also be useful in the materials, components, devices, and methods of this invention.

Although the open-ended term "comprising," as a synonym of terms such as including, containing, or having, is use herein to describe and claim the present invention, the invention, or embodiments thereof, may alternatively be described using more limiting terms such as "consisting of" or "consisting essentially of" the recited components.

Watercraft Vessel Anchoring System

The present technology provides an anchoring system developed for use in recreational watercraft vessels also known as small watercraft vessels that include: kayaks, canoes, drift-boats, john-boats, inflatable pontoon boats, skiffs, flat-boats used in shallow salt waters and other small watercraft vessels, typically less than 25 feet in length. Typically, these watercraft vessels can require safe anchoring at depths no greater than about four to six feet. As used herein, the term vessel can refer to kayaks, canoes and shallow water drift-boats. The intended use of the present anchoring system in vessels described herein, can include, rivers having slow to moderate flows, shallow lakes, ponds, salt water flats, at depths ranging from about 0.1 feet to about 6.0 feet, more preferably from about 1.0 feet to about 6.0 feet, from about 2.0 feet to about 6 feet, or from about 3.0 feet to about 6.0 feet, or from about 4.0 feet to about 6.0 feet, or from about 0.1 feet to about 5.5 feet, or from about 0.1 feet to about 5.0 feet, or from about 0.1 feet to about 4.5 feet, or from about 0.1 feet to about 4.0 feet, or from about 0.1 feet to about 3.5 feet, or from about 0.1 feet to about 3.0 feet. Typically, the anchoring system of the present technology is not intended for use in fast flowing "white water" rivers or bodies of water having depths greater than 6 feet without unacceptable risk to the operator. Other uses include deployment of the anchoring system a few inches into floating weed masses over deep water (i.e. greater than 6.0 feet) holding the water vessel in place. In some embodiments, the anchoring system of the present technology can be mounted to the vessel on the bow or the stern of the vessel or both.

In one embodiment, the anchoring system for anchoring a watercraft vessel in a river or other shallow water body is illustrated in FIGS. 1A-1D. Although the watercraft vessel illustrated in FIGS. 1A-1D, is a kayak, the anchoring system of the present technology can be mounted on all of the watercraft vessels described above in addition to others. In some embodiments, the anchoring system comprises a bracket 42 that is mounted to the watercraft vessel 15. The bracket 42 has a mounting flange 30 that can be mounted to the watercraft vessel at either the stern or bow. Bracket 42 can be made of any suitable material that is resilient to the stress imposed by the sliding tube 53 and rod 60 when deployed. The bracket 42 can be manufactured from metal, for example, stainless steel, iron, titanium, aluminum and alloys thereof, dense plastic, for example, polyvinyl chloride (PVC), high density polyethylene, polycarbonate and the like and carbon containing materials and composites, for example carbon fiber. The bracket 42 can also be manufactured from advanced light weight carbon containing composites. Bracket 42 can include a top surface aperture 27 and a bottom surface aperture 28. These apertures provide a passage for a sleeve 50 to be welded to the bracket 42.

Figure 1B:
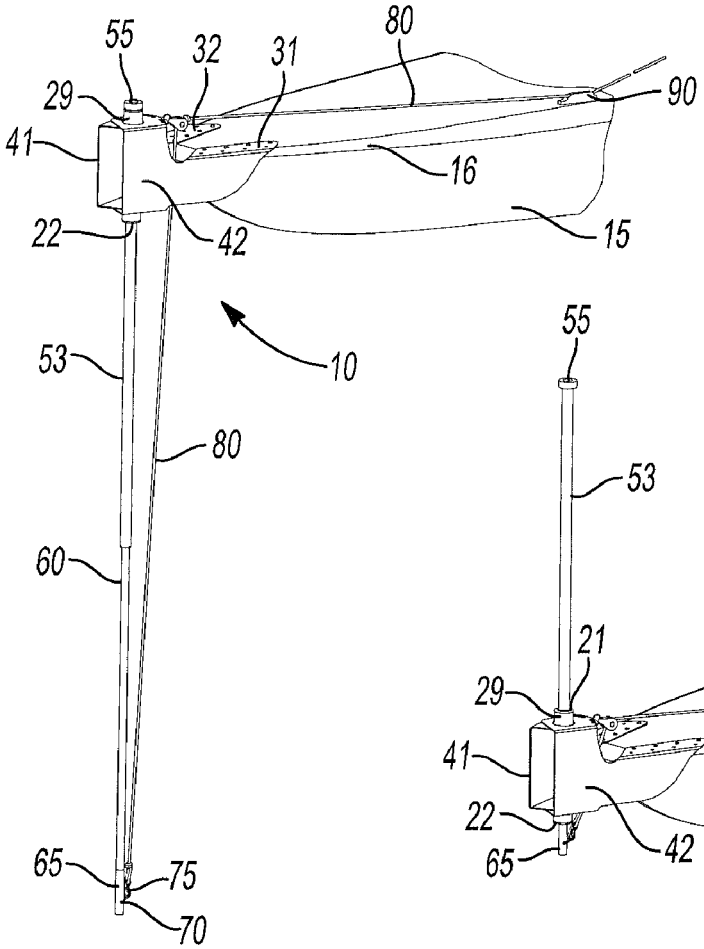
Figure 1C:
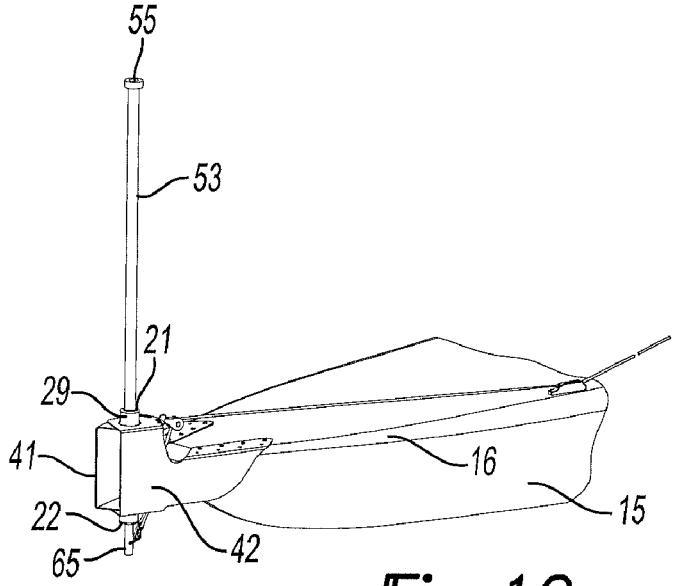
Figure 1D:
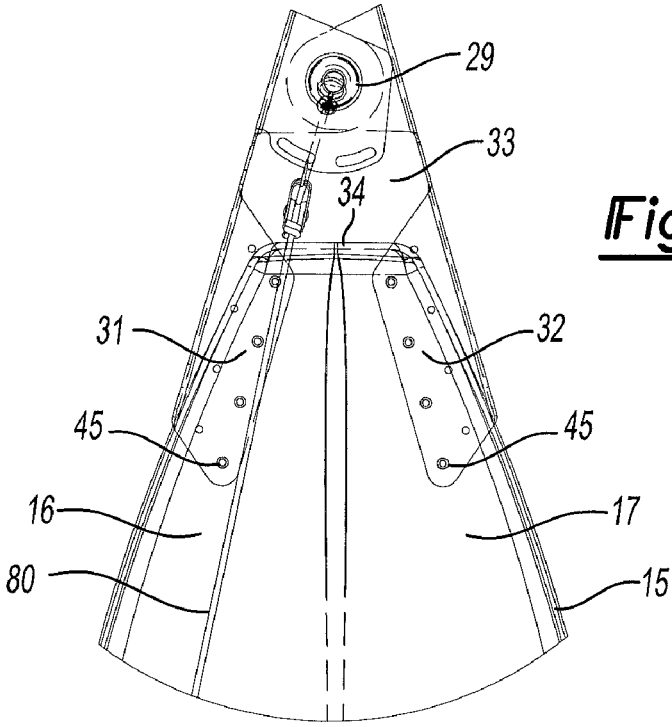

Bracket 42 can be a single bracket element that is part of a dual bracket configuration as shown in FIGS. 1A-1D. As shown in FIG. 1D, the brackets 42 and 41 form a supporting structure for sleeve 50. In one embodiment, brackets 41 and 42 are hinged brackets that can be spaced apart to fit onto the watercraft vessel 15 shown in FIGS. 1B-1C as the bow. The mounting flanges 31 and 32 can be fixed onto the top surface 16 and 17. The brackets 41 and 42 can be bolted or riveted through apertures 45. However, other fastening systems for metal on plastic, fiberglass, Kevlar, carbon or wood can also be used. These non-limiting examples include bolts and nuts, adhesives, clamps, clips and the like. As shown in FIG. 1D, the brackets 31 and 32 are pivotable about the axis of the sleeve 50. The bracket aperture 27 provides a passage for the sleeve 50 to exit, while the bracket aperture 28 provides the second end of the sleeve 50 to exit. In an illustrative example shown in FIG. 1D, bracket 31 can be bolted to the watercraft vessel 15 at the top surface 16 and bracket 32 can be rotated and adjusted to position apertures 45 onto a top surface 17 for fastening and securing with fasteners described above. The brackets 31 and 32 extend beyond the tip 34 of the watercraft vessel 15 leaving a passage 33 between the watercraft vessel 15 and the top of sleeve 50.

Referring now to FIGS. 2A-2C, the anchoring system 10 can have a single bracket 20 having a mounting flange 30 which is the portion of the bracket 20 that is used to fasten bracket 20 to the top surface 16 of watercraft vessel 15. Bracket 20 can also have a sleeve attachment flange 44 which is used to attach and mount sleeve 50 in a vertical position. Sleeve attachment flange 44 can be welded glued or affixed to sleeve 50 in any appropriate manner used for aquatic environments. As shown in FIGS. 2A-2C, mounting flange 30 can be affixed to top surface 16 with rivets, bolts, boat screws, nuts, adhesives inserts and other forms of fastening used in boat and watercraft vessel construction.

Figure 3C:
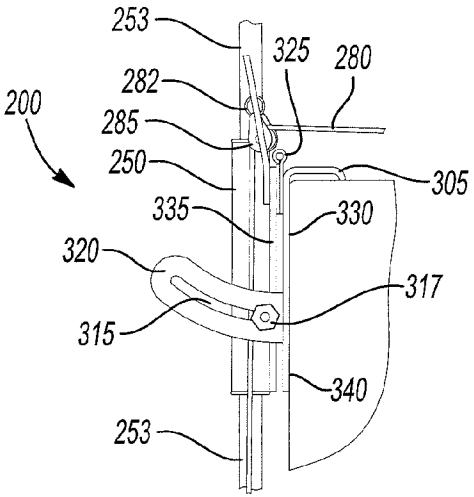
FIG. 3C depicts partial side elevation view of a long-boat or drift-boat with a vertical transom having a modified bracket arrangement as depicted in FIG. 3A in accordance with the present technology.
Figure 3D:
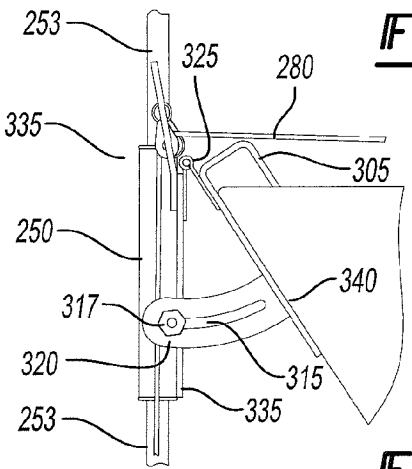
FIG. 3D depicts partial side elevation view of a long-boat or drift-boat with a angular transom having a modified bracket arrangement as depicted in FIG. 3A in accordance with the present technology.

In some embodiments, the anchoring system of the present technology can include a bracket that fits over the walls of a watercraft vessel 15, as in the case of a drift boat 215 or longboat or rowboat (not shown). The bracket 200 can be fitted over a boat wall 217 or a vertical transom 330 or angled transom 340. A U-shaped bracket member 305 is placed over the boat wall 217 or a vertical transom 330 or angled transom 340. Mounted to U-shaped bracket member 305 is a guide plate 320. Guide plate 320 has an arcuate inner channel 315 to guide bolt 317 that fastens sleeve support 335. Sleeve support 335 is biased with pin 325. The bracket 200 is shown in a resting or deployed state in FIGS. 3C and 3D for a watercraft vessel having a vertical transom 330 and angled transom 340. As can be seen, bracket 200 permits the deployment of sleeve 250 and sliding tube 253 in a vertical orientation. U-shaped bracket member 305, guide plate 320, pin 325 and sleeve support 335 can all be made from rust resistant metal, carbon containing composite, ceramic or hard plastic materials. In some embodiments, U-shaped bracket member can be affixed to the vertical transom 330 and angled transom 340 with the use of rivets, pressure pad bolts, "elevator" bolts or outboard motor type hand tightened pressure bolts, nuts, boat screws, inserts, or welded to a mounting of the stern, bow or side wall of the watercraft vessel 215. The manner in which the sliding tube 253 is raised and lowered in the same as for other anchoring systems illustratively shown in FIGS. 1A and 2A.

Figure 4A:
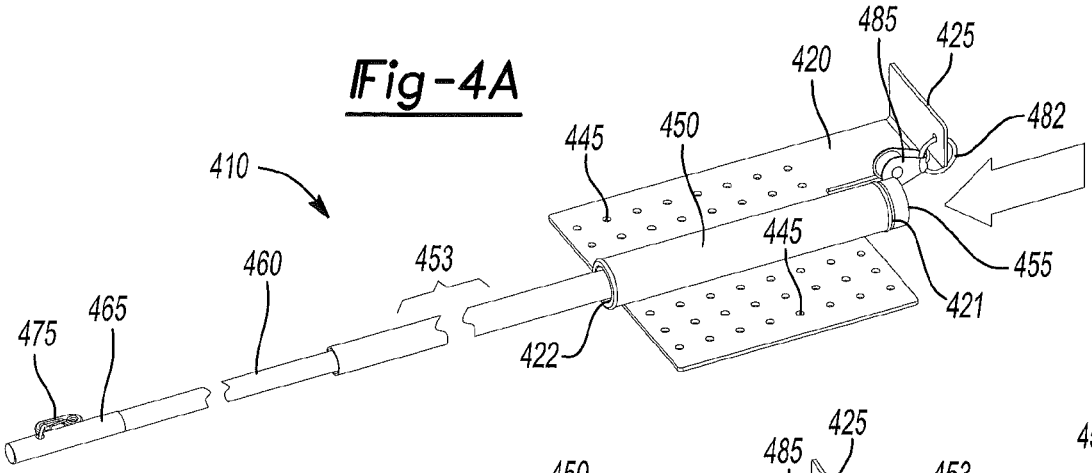
FIG. 4A depicts a partially exploded view of an anchoring system designed for a pontoon boat in accordance with the present technology.
Figure 4B:
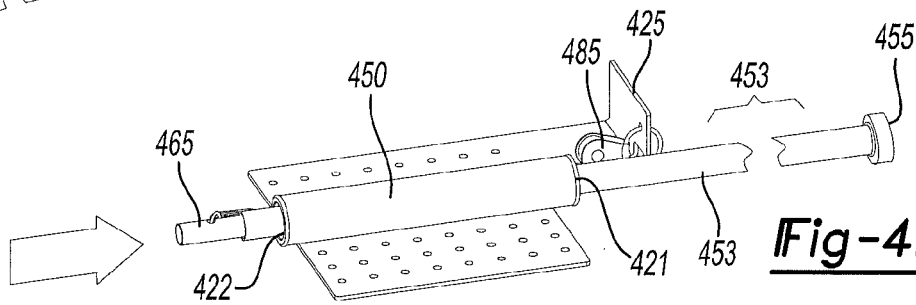
FIG. 4B depicts a partially exploded view of an anchoring system designed for a pontoon boat as shown in FIG. 4A in a resting or retracted orientation in accordance with the present technology.
Figure 4C:
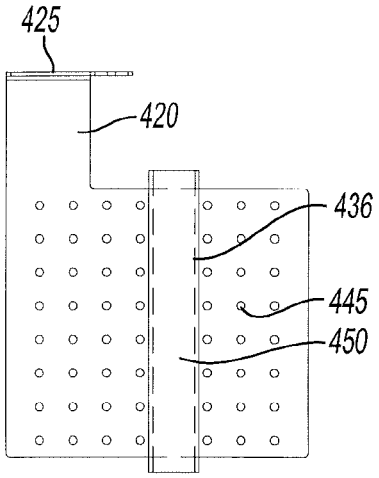
FIG. 4C depicts a front view of the bracket attached to a sleeve used in FIG. 4A and FIG. 4B in accordance with the present technology.
Figure 4D:
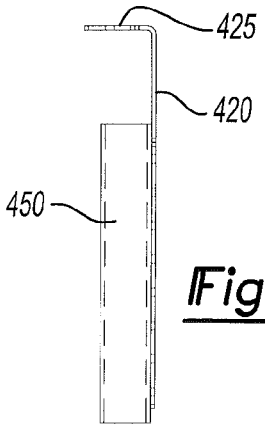
FIG. 4D depicts a side elevation view of the bracket and sleeve of FIG. 4C in accordance with the present technology.

In some embodiments, the anchoring system of the present technology can also be mounted to watercraft vessels, for example, inflatable pontoon boats and vessels (not shown). As best represented in FIGS. 4A-4D, the bracket 420 includes a mounting flange 425 for mounting a pulley. The bracket 420 can also be mounted to a planar surface (not shown), for example, inflatable pontoon frame tubing by affixing rivets, bolts, for example, U-bolts, nuts, boat screws, inserts or other forms of attachment via apertures 445. FIG. 4A is showing the anchoring system 410 in a deployed view, with the sliding tube 453 and rod 460 in an elongated position. FIG. 4B shows the same anchoring system 410 in a resting position, such as when the watercraft vessel is traveling on the surface of the water, or when the watercraft vessel is being transported to and from the water body. The sleeve 450 can be attached to bracket 420 using any form of attachment, including, welded joints, straps, adhesives or can be riveted, screwed with boat screws or bolted through apertures 445.

Figure 5:
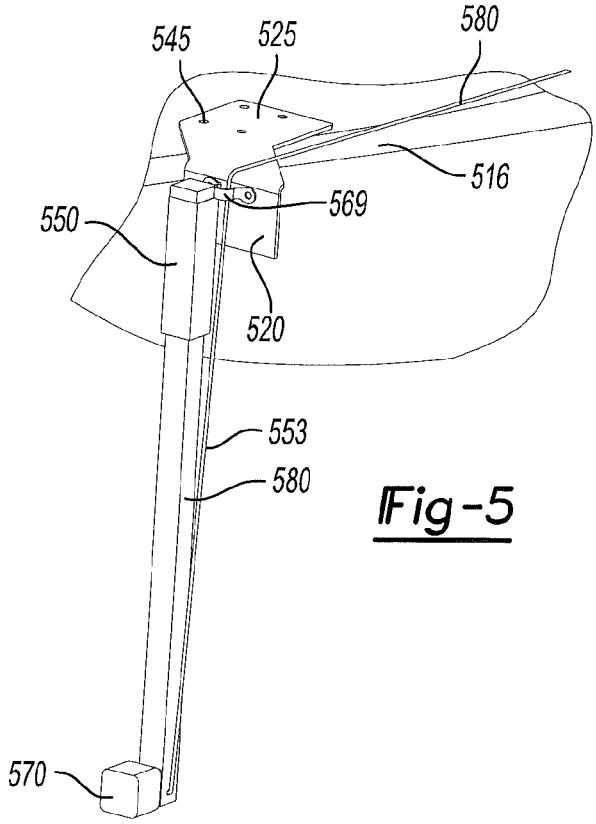
FIG. 5 depicts a partial perspective view of a sensing device mounted to a sliding tube of the anchoring system in accordance with the present technology.

FIG. 5 illustrates a deployable anchoring system modified for use as a support for a electronic or mechanical sensing device 570 to aid in fishing. For example, a sensing device can include one or more of a sonar transducer, a light source, for example, a light bulb, LED and the like, a video camera, a thermometer and combinations thereof. One or more of these sensing devices 570 can be attached to sliding tube 553 and lowered during operation of the watercraft vessel without the end of the sliding tube 553 from contacting the bottom of the river, lake or ocean flat. Bracket 520 can be hinged and have a mounting flange 525 to be affixed to the watercraft vessel top surface 516 through apertures 545 using rivets, boat screws or bolts and nuts.

Referring now to FIGS. 1A, 1B, 2A, 3A, 4A and 5, typically connected to brackets 42, 41, 42, 20, 200, 420 and 520 are a hollow sleeve having an outer wall surface and an inner wall surface defining a longitudinal aperture 52 operable to permit a sliding to pass therethrough. With reference to FIG. 1A, Sleeve 50 can measure from about 3.0 inches to about 12 inches. Preferably, the geometric shape of sleeve 50 is the same as the sliding tube 53. In some embodiments, the sleeve 50 can have cross-sections shaped in a circular, ovals, triangular, square, rectangular, rhomboid and any geometric shape that can be manufactured. Preferably, the sleeve 50 has a circular or square cross section. In some embodiments, the sleeve 50 can be cylindrical, rectangular, triangular, square, trapezoidal and variations thereof. In some embodiments, the length of the sleeve 50 can be at least about 3 inches, or at least about 5 inches, or at least about 7 inches, or at least about 9 inches, or at least about 12 inches or at least about 15 inches in length. The interior wall of sleeve 50 defines a longitudinal aperture 52. The sleeve 50 can have an opening at a first end 21 and at a second end 22 thereby defining an open hollow cylinder as shown in FIG. 1A.

Since the sleeve 50 is operable to support, balance and keep sliding tube 53 substantially vertical, the inner diameter of sleeve 50 is such that it is generally greater than the outer diameter of sliding tube 53, which is slidable within sleeve 50. In some embodiments, the sleeve 50 can have an outer diameter ranging from about 1.0 to about 3.0 inches, with an internal diameter of at least about 0.5 inches, at least about 0.75 inches, at least about 1.0 inches, at least about 1.25 inches, at least about 1.5 inches, at least about 1.75 inches, at least about 2.0 inches or at least about 2.75 inches. The sleeve 50 can be made from any suitable material that is resilient to the stress imposed by the sliding tube 53 and rod 60 when deployed. The sleeve 50 can be manufactured from metal, for example, stainless steel, iron, titanium, tantalum, aluminum and alloys thereof, ceramics, hard plastics or wood. The sleeve 50 can also be manufactured from advanced light weight carbon containing composites.

In some embodiments, the sleeve 50 can be fitted with a liner 36 that is inserted in the longitudinal aperture 52. The liner 36 serves to reduce vibration and noise created by the raising and lowering of sliding tube 53. The liner 36 can be made from any material for example, rubber, soft thermoplastic materials, for example, polyolefins, hard plastic, for example, high-density polyethylene (HDPE) tube liners, bushings or fixed tubes with interior lumen surface coatings that reduces friction and noise of the sliding tube 53. The dimensions of the liner 36 can fall within the specifications of the longitudinal aperture 52 of the sleeve 50 and has an outer diameter that is less than the inner diameter of sleeve 50 but is greater than the outer diameter of sliding tube 53. The liner can also include a coating on the inner wall of sleeve 50. The coating can include one or more materials including Teflon®, rubber or a plastic material that effectively reduce the vibration and noise of the sliding tube being retracted and deployed.

In some embodiments, best illustrated in FIG. 5, sleeve 550 can have a square cross-section and have a rectangular shape. Similarly, sliding tube 53 can slide within sleeve 50 and also has a square cross-section and be rectangularly shaped.

Sliding within sleeve 50 is sliding tube 53. Sliding tube 53 can be used to at least partially house rod 60 and provide the necessary length for the anchor to reach the bottom of the river, lake or ocean floor. Sliding tube 53 has a first end 21 which has an end cap 55 attached. End cap 55 has an outer diameter that is greater than the outer diameter of sleeve 50. The end cap 55 prevents sliding tube 53 from sliding completely through sleeve 50 when the sliding tube is released for deployment. End cap 55 can be made of any material that can be affixed to the sliding tube. Alternatively, end cap 55 is congruent with and part of sliding tube 53 and molded from the same material as sliding tube 53. In some embodiments, the stop cap can be a cap made from plastic for example, poly vinyl chloride, rubber, and a welded lightweight metal such as aluminum, steel or titanium. FIGS. 1B and 1C illustrate the deployment of the sliding tube 53 and rod 60. In FIG. 1B, the sliding tube 53 has reached its elongated position and it is readily seen that end cap 55 prevents the passage of sliding tube 53 to slide through the top 29 of sleeve 50. In FIG. 1C, sliding tube 53 and rod 60 are raised through sleeve 50 and are in a resting position.

With reference to FIGS. 1A-1D and 2A-2C, sliding tube 53 can be made from any solid material, preferably stress and rust resistant material. In some embodiments the sliding tube 53, can be made from dense plastics, for example, poly vinyl chloride, high density polyethylene, metal materials, for example, aluminum, iron, titanium, tantalum, EMT metal conduit material, stainless steel and alloys thereof, carbon containing materials and wood. Sliding tube 53 can be completely hollow having a thin wall or it can be partially hollow as shown in FIG. 1A defined by the first end 57 of rod 60 and the second end 54 of sliding tube 53. Preferably, sliding tube 53, is completely hollow and permits the retraction of rod 60 from its elongated position as shown in FIGS. 1A and 2A into sliding tube 53 as shown in FIGS. 1C and 2C in its resting position. The outer diameter of the sliding tube 53 can range from about 0.4 inches to about 2.9 inches. The internal diameter of sliding tube 53 can range from 0.3 inches to about 2.8 inches. In some embodiments, the length of sliding tube 53 can vary from about 15 inches to about 5 feet.

Figure 3A:
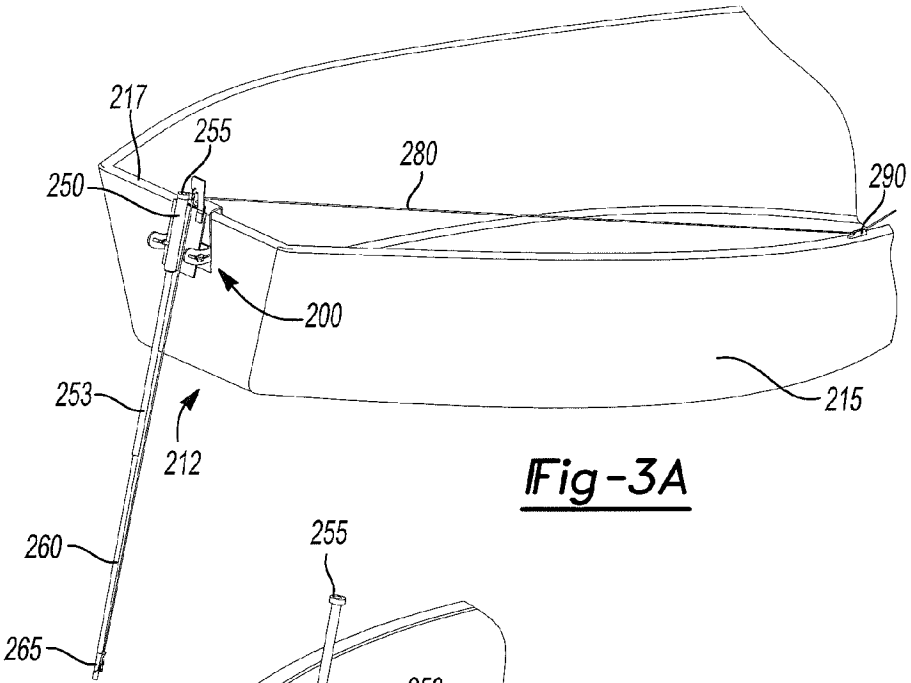
FIG. 3A depicts partial side elevation view of a long-boat or drift-boat having a modified bracket arrangement in an elongated orientation in accordance with the present technology.
Figure 3B:
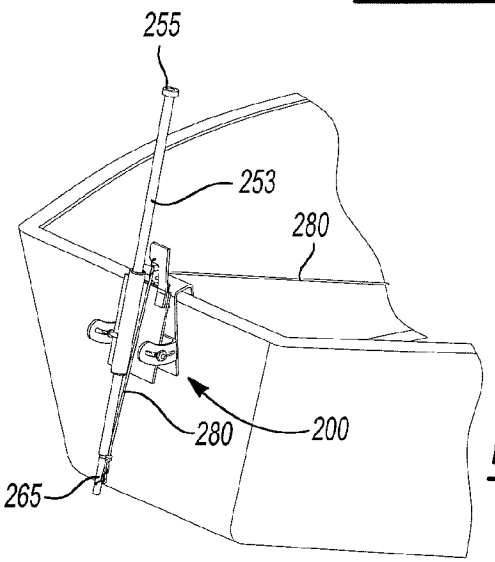
FIG. 3B depicts partial side elevation view of a long-boat or drift-boat having a modified bracket arrangement as depicted in FIG. 3A wherein the anchoring system is in an resting or retracted orientation in accordance with the present technology.

The anchoring system of the present technology also includes a rod having a first end disposed within the sliding tube and a second end having a floor contact tip. With reference to FIGS. 1A-1D and 2A-2D, rod 60 is shown in an elongated position in FIG. 1A. The first end 57 of rod 60 is shown within sliding tube 53 in the elongated position. Rod 60 has a second end or floor contacting tip 65. Attached to floor contacting tip 65 of rod 60 are a ring 70 and a mini clip 75. Floor contacting tip can have a perforation which can be used to fasten retraction member 80. Alternatively, the rod tip perforation can be used to fasten a ring 70 and mini clip 75, as shown in FIGS. 1A, 2A and 3A. Rod 60 can have any cross-section that permits rod 60 to slide within sliding tube 53. In some embodiments, when sliding tube 53 has a circular cross-section, rod 60 also has a circular cross-section. Rod 60 can be made from a metal, ceramic, hard plastic, fiberglass, carbon containing material or composite, for example, carbon fiber and wood. In some embodiments, rod 60 can be made from hollow blanks or can be completely solid. In order for the rod 60 to slide at least partially into sliding tube 54, rod 60 has an outer diameter that is smaller than the inner diameter of sliding tube 60. The length of rod 60 can range from about 5 inches to about 5 feet.

In some embodiments, floor contacting tip 65 can be coated with a plastic or rubber material forming an outer layer on floor contacting tip, floor contacting tip 65 can be capped with a plastic or rubber material, or both. The outer layer can vary in thickness ranging from 0.01 mm to about 5 mm. The floor contacting tip 65 can terminate in a point or can be flat as shown in FIGS. 1A, 2A, 3A and 4A.

As stated above, rod 60 can include a ring 70 which is fastened to floor contacting tip 65. A retraction member 80 can be directly fastened to floor contacting tip 65 of rod 60 or it can be fastened to hardware such as mini clip 75 which is also fastened to ring 70. The retraction member 80 can be any device that can be attached or coupled to either rod 60 at either the rod first end 57 or floor contacting tip 65 or the sliding tube second end 54 and is configured to raise the rod 60 and sliding tube 53. In non-limiting Illustrative examples of retraction member 80 can include rope, cord, cables, flexible pole, wire or combinations thereof. Preferably, retraction member 80 includes sailing rope capable of being attached to the rod. In some embodiments, the retraction member 80 can be made from nylon, polyester, polypropylene, kevlar, spectra, vectran, dyneema, braided wires, manila and other marine or boating roping materials. The retraction member 80 can be a synthetic rope, having a diameter ranging from 0.25 inches to 0.75 inches. Preferably, the retraction member 80 is an ergonomic, comfortably sheathed nylon rope which provides a comfortable grip having a diameter of about ⅜ inch diameter.

As shown in 2A, a rope pulley 85 can be connected to a clip 82 that is tethered to sleeve 50 or as shown in FIG. 1A, to the bracket lip 25. Rope pulley 85 can be compatible with the retraction member 80 and facilitate the raising and lowering of rod 60 and sliding tube 53. The rope pulley 85 can be used for receiving and guiding the retraction member 80.

In some embodiments, the rod 60 can be connected to a retraction member 80. Retraction member 80 can then be connected to an automated or electronic winch which can retrieve and release the retraction member and effectively raise and lower the rod 60 and sliding tube 53.

While the various embodiments discussed herein are related to anchoring systems that are mounted to the watercraft vessel 15, other designs including attachable anchoring systems that can be placed on and off the watercraft vessel 15 can also be contemplated. The present technology also provides for temporary or removable anchoring by mounting an adapter bracket (not shown) to a flexible marine fabric or mounting harness (not shown) that can be reversibly attached to the vessel via a plurality of mounting straps (not shown). The adapter bracket can be mounted to a support board (not shown) that is attached to a sleeve 50. The difference in how the anchoring system is mounted to the vessel lies in the use of a marine fabric (not shown) that can be used as a harness around the bow or stern or both of the watercraft vessels 15. The harness can be further supported with a pair of support straps stitched or otherwise fastened to the marine fabric. In some embodiments, the marine fabric can be made from any synthetic or natural material that can support the weight of the vessel in the current of the water during anchoring. In some embodiments, to increase the strength of the marine fabric, integrated support straps can be stitched to the fabric and can also have a D-ring mounted on one end Some illustrative examples of the marine fabric can include plastic, vinyl, polyester, neoprene, hypalon, canvass, "heat shrink", nylon, acrylics, trampoline fabric and combinations thereof. The marine fabric is mounted to the stern, bow or both and can be attached to the vessel via a mounting strap attached at one end to the D-ring and marine fabric and a second end to the vessel structure, for example to a handle mounted on the vessel.

The mounting strap can be elastic and/or can also include a mini ratchet (not shown) that permits tightening of the marine fabric to the watercraft vessel 15. The flexible/removable anchoring system can be removed without any structural alteration to the watercraft vessel 15 i.e. the flexible/removable anchoring system can be mounted without having to permanently mount any component shown in FIGS. 1A-5, and stored away when not in use.

Method of Use

The present technology provides for an anchoring system that is particularly suited for bodies of water including stationary or moderately flowing rivers, lakes, ponds, salt water flats and estuaries. The operator of the watercraft vessel can deploy the anchoring system 10 of the present technology, preferably at depths no greater than 2-6 feet while sitting or standing. With reference to the FIGS. 1A-1D, 2A-2C and 3A-3D, the method for using the anchoring system of the present technology can include: (a) providing a watercraft vessel 15 having an anchoring system 10, the anchoring system 10 can include: (i) an anchor bracket 42, 41, 20 or 200 configured to be mountable on the watercraft vessel 15; (ii) a sleeve 50 attached to the anchor bracket 42, 41, 20 or 200, the sleeve having a longitudinal aperture 52 disposed longitudinally therethrough; (iii) a sliding tube 53 inserted through the sleeve 50, the sliding tube having a first end terminating as an end cap 55 and a second end 54, the end cap 55 of the sliding tube has a diameter greater than sleeve 50, and second end 54 has a lumen disposed longitudinally at least partially therethrough. The sliding tube 53 is configured to have a first resting position and a second deployed position; (iv) a rod 60 having a first end 57 disposed at least partially within the sliding tube 53 lumen and a second end having floor contacting tip 65. The rod 60 is configured to have a first resting position and a second deployed position; and (v) a deployment means. The deployment means can have a retraction member 80 connected to the rod 60. The retraction member 80 is configured to move the rod 60 and the sliding tube 53 between their elongated position and their resting position. The method also includes making the watercraft vessel 15 essentially stationary on the body of water; and deploying the anchoring system 10, such that the sliding tube 53 and the rod 60 are moved into their elongated position and the floor contacting tip 65 is at least partially embedded in the bottom of the river, lake, pond, creek or salt water or ocean flat.

As shown in FIGS. 1A, 2B and 2C, the sliding tube 53 and rod 60 can be deployed into their elongated position by releasing the retraction member 80 from the retraction member fastener 90. In some embodiments, the retraction member 90 can be any fastening member, for example a nail, a clip, a cleat or a winch. As depicted in FIGS. 1A, 2B and 2C, the retraction member fastener 90 is a clam cleat. Once the retraction member 80 has been released, gravity causes the sliding tube 53 and rod 60 disposed at least partially therein to drop. The sliding tube 53 will drop until end cap 55 is in contact with sleeve 50 as the end cap 55 has a diameter greater than the diameter of sleeve 50. The floor contacting tip 65 will then contact the floor surface and may penetrate the floor of the bottom or will lodge between obstacles or structures on the floor and cause the watercraft vessel 15 to become stabilized and stationary.

Preferably, the anchoring system 10 can be deployed in stationary flow or if traveling sufficiently slowly, but designed so that the operator first stops the craft, then releases the retraction member 80 from the retraction member fastener 90 and permitting the sliding tube 53 and rod 60 to vertically drop due to gravity, until the floor contacting tip 65 of the rod 60 hits the surface of the river, lake or sea floor. As the wind or current acts on the watercraft vessel to move it in slowly in any direction, the tip of the rod drags on the floor, typically 4-10 inches, slightly displacing the bottom material while correspondingly descending further into the bottom until the increased friction is sufficient to stop the rod, and thus stopping the vessel. In cases where there is a moderate current or tide, the operator can use their paddle to back peddle or pole the watercraft vessel to an essentially stationary position and then deploy the anchor. As used herein, the term essentially stationary means that the water craft vessel is moving less than $1/10^{th}$ the speed of the body of water at the surface. This operation can be performed while the operator of the watercraft vessel is seated or standing by manipulating the deployment rope.

To raise the rod 60 and sliding tube 53 from their elongated position to their resting position, the watercraft vessel operator can simply pull on the retraction member that can be connected to either the rod 60 or the sliding tube 53. Preferably, and as shown in the various Figures herein, the retraction member 80 is pulled thereby raising the rod 60 into the sliding tube 53. The retraction member 80 can then be pulled until the desired position of the rod 60 and sliding tube 53 is attained shown illustratively in FIGS. 1C and 2C, and the watercraft vessel 15 can be placed in motion and free of any obstacles in the water.

The anchor deployment is essentially silent which provides superior conditions for stalking fish or presenting a fishing fly or lure to a school of fish nearby. Moreover, the use of the anchoring system of the present invention permits the fisherperson to stealthily position themselves in their vessel close to the target fish. First by allowing the angler to remain almost perfectly still, just moving a forearm, wrist and fingers, low along the lines of the vessel or retrieving the deployment rope, which does not create a moving profile above the water line which signals danger and frighten fish. Additionally, the ever so slight motion required for the angler to use the anchoring system will not rock the watercraft vessel 15, and therefore will not create surface waves which also frighten fish in shallow water. Furthermore, an added advantage of the present anchoring system is that the operator can deploy the anchor with one hand, leaving the other hand to retain the paddle, fishing rod, or other item in the vessel thus enhancing safety and enjoyment. The floor contacting tip 65 of rod 60, once rested on the bottom, provides an unprecedented front-to-back or side-to-side stability without the necessity to drive the rod into the bottom of the river, lake or ocean floor.

Once the operator is ready to raise the anchoring system 10 of the present technology, the operator releases the rod 60 from the river or sea floor by pulling on the retraction member 80 and thereby raising the rod 60 and sliding tube 53 to its resting position. It is also believed that the raising of the rod 60 and sliding tube 53 requires only one step and can be performed with one hand, or even just a few fingers and a thumb, with minimal assertion. Rather than facing the direction in which the anchor in a conventional anchor/rope system has been placed to retrieve the anchor line and anchor itself, the present technology provides for one hand anchor retraction while seated or standing facing the direction of intended travel, incurring virtually no shifting of the body which would otherwise create a rocking or instability of watercraft vessels, especially beamed canoes and kayaks.

The following examples are illustrative of the certain aspects of the disclosure and should not be construed as limiting in scope of the disclosure.

EXAMPLES

Example 1

Anchoring Efficiency of a Non-Limiting Embodiment of the Anchoring System

An anchoring system was built using a piece of 1×8×4 feet with two 4×6 blocks stacked to form the mounting bracket, screwed and glued together and to the end of the 1×8 which hung over the back of the kayak. Relief holes were cut to allow the drain plug and handle to come through the frame at the back of the kayak. The frame was tied down at the back end of the kayak and through the back kayak frame member behind the seat with ⅜ inch nylon rope.

A 12 inch vertical sliding sleeve of 2 inch PVC was attached vertically on the very end of the 4×6 blocks with 3 galvanized 2 inch pipe straps. A 5 feet section of 1-½ inch PVC was slid through the vertical sliding sleeve, and a drilled out PVC cap was glued to the top of the pipe to keep it from dropping through the sliding sleeve. A deployment rope was attached to the bottom of the 1-½ inch PVC pipe, taken straight vertical to a pulley that was mounted on the 4×6 blocks, then taken to a pulley mounted on the top edge of the kayak near the seat, then taken through a cam cleat mounted on the left arm rest by the seat.

The anchoring system was installed on the fixtured test bed, on a Native Ultimate 12 kayak, and launched in a river with various current flow speeds. After drifting a short distance from shore, aligned and traveling with the current, in approximately 2 feet of water, over gravel and softball sized rocks, in medium current speed, we deployed the anchoring system. The kayak came to a slow stop after the rod tip dragged for about a foot. This test and others are found in Table 1 below.

TABLE 1

Anchoring Performance In A River After Deploying The Anchor While Moving

| Water depth | Bottom composition | Current speed | Drag distance to stop |
|---|---|---|---|
| 6" | Softball and toaster sized rocks | Fast for river | 3' |
| 2' | Gravel, sand, softball sized rocks | Medium for river | 2' |
| 1' | Sand | Slow for river | 6" |
| 3' | Gravel, sand, softball sized rocks | Medium river | 2' |

It was observed that the rod tip dragged for an unacceptable distance when the kayak was pointing down river, traveling at current speed, and the anchor deployed. It should be noted that this happens with a standard anchor, too. A test was therefore conducted whereby the operator back paddled to slow the kayak's downstream progress to almost stopped, then the anchor was deployed. It was thought that this is not a burden to the operator, in fact more realistic, as this is often done with standard anchor methods. When this method is used, the following results in Table 2 were obtained:

TABLE 2

Anchoring Performance In A River While Deploying The Anchor After Back Paddling To A Stop

| Water depth (Inches) | Bottom composition | Current speed | Drag distance to stop (Inches |
|---|---|---|---|
| 6 | Softball and toaster sized rocks | Fast for river | 6 |
| 2 | Gravel, sand, softball sized rocks | Medium for river | 6 |
| 1 | Sand | Slow for river | 3 |
| 3 | Gravel, sand, softball sized rocks | Medium for river | 6 |

Using the anchoring system with the back paddling method was successful. A drag distance of 6 inches is considered a precise anchoring event. The anchoring system was then deployed and raised while fishing for another hour, or approximately 20-30 times with the same results. Lifting the anchor was smooth and easy. Lifting from deployment in 0.1-3 feet of water required two grasp and pulls of the deployment rope—with two fingers and a thumb. A quality wedge-type cleat is all that was necessary to hold the weight of the anchor when it is fully lifted (stored). The anchoring system holds the kayak in a directly downstream pointing direction.

Example 2

Anchoring Efficiency of the Anchoring System Embodiment 2

Modifications were made to the anchoring system in Example No. 1. The telescoping tube of the anchoring system was down from 40 inches, and attached to the last 16 inches of the stern of the kayak. The ⅜ inch deployment rope was replaced with two 1 inch tie-down ratchet straps for affixing the anchoring system to the kayak. Removed the existing 8 inch×2 inch PVC sleeve and added a PVC sleeve at 8 inch×1-¼ inch ID. The anchoring system of Example 1 utilized a 32 inch×¾ inch piece of EMT metal conduit as the "second sliding sleeve" or outer telescoping tube in the telescoping configuration, and a 36 inch×⅝ inch solid steel rod, zinc plated tip sliding inside, and designed to contact the bottom. A 6 inch piece of ¾ inch ID reinforced rubber hose was added to the very tip of the rod tip for quiet deployment. This modification was called "configuration A".

A second configuration (configuration B) was prepared using a 32 inch×¾ piece of EMT metal conduit as the "second sliding sleeve" or outer telescoping tube in the telescoping configuration, and a piece of 36 inch×½ inch EMT metal conduit rod tip sliding inside, designed to contact the bottom. A 6 inch piece of ¾ inch ID reinforced rubber hose was added to the very tip of the rod for quiet deployment. This modification was called "configuration B". Upon arriving at the same location in the river as tested in Example No. 1, and observing the current flow, we determined conditions to be consistent with the test conditions tested in Example 1. All tests were performed using the same method of back paddling to a stop, and then deploying the anchoring system as described above. Test results are found in the table below:

TABLE 3

| Configuration A, 5/8 inch steel rod tip | | | |
|---|---|---|---|
| Water depth (Inches) | Bottom composition | Current speed | Drag distance to stop (Inches) |
| 2 | Sand | Fast for river | 6 |
| 1 | Gravel, sand, softball sized rocks | Fast for river | 12 |
| 6 | Softball and toaster sized rocks | Fast for river | 6 |
| 1 | Sand | Medium for river | 0 |
| 3 | Gravel, sand, softball sized rocks | Medium for river | 6 |
| 1 | Softball and toaster sized rocks | Medium for river | 0 |
| 3 | Sand | Slow for river | 0 |
| 2 | Gravel, sand, softball sized rocks | Slow for river | 0 |
| 2 | Softball and toaster sized rocks | Slow for river | 0 |

TABLE 4

| Configuration B, 1/2 inch steel rod tip | | | |
|---|---|---|---|
| Water depth (Inches) | Bottom composition | Current speed | Drag distance to stop (Inches) |
| 2 | Sand | Fast for river | No test |
| 1 | Gravel, sand, softball sized rocks | Fast for river | 24 |
| 6 | Softball and toaster sized rocks | Fast for river | Did not stop |
| 1 | Sand | Medium for river | 0 |
| 3 | Gravel, sand, softball sized rocks | Medium for river | 12 |
| 1 | Softball and toaster sized rocks | Medium for river | Did not stop |
| 3 | Sand | Slow for river | 0 |
| 2 | Gravel, sand, softball sized rocks | Slow for river | 0 |
| 2 | Softball and toaster sized rocks | Slow for river | 0 |

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An anchoring system for a watercraft vessel, the anchoring system comprising an anchor bracket configured to be mountable on said watercraft vessel; a sleeve attached to said anchor bracket, said sleeve having an aperture disposed longitudinally therethrough; a sliding tube inserted through said sleeve, said sliding tube having a first end and a second end, said sleeve being at least partially hollow; a rod having a first end disposed within said second end of said sliding tube and a second end having a floor contacting tip; and a deployment means selected from the group consisting of a cord, a rope, a cable, a flexible pole, a wire and combinations thereof, said deployment means connected to said rod, said deployment means configured to retract said rod into said sliding tube and retract said sliding tube through said sleeve.

2. The anchoring system according to claim 1, further comprising an end cap disposed on said first end of said sliding tube, said end cap having a diameter greater than the diameter of said sleeve aperture, said end cap being operable to limit travel of said sliding tube through said sleeve.

3. The anchoring system according to claim 1, wherein said bracket includes an outer bracket and an inner bracket, and wherein at least one of said inner bracket and said outer bracket is pivotable around said sleeve.

4. The anchoring system according to claim 1, wherein said bracket further includes an arcuate fastener assembly operable to fasten said sleeve in a generally perpendicular orientation with respect to said bottom surface.

5. The anchoring system according to claim 1, wherein said sleeve further includes a hollow liner disposed within said aperture of said sleeve.

6. The anchoring system according to claim 1, wherein said anchoring system further includes a rope pulley secured to at least one of said bracket and said sleeve.

7. The anchoring system according to claim 1, wherein said rod further includes a coupling attached to said second end of said rod operable to couple said deployment means.

8. The anchoring system of claim 1, wherein said anchoring system further includes a retraction member fastener for mounting to the watercraft, vessel, said retraction member fastener being operable to restrain said deployment means.

9. The anchoring system according to claim 1, wherein said sliding tube or said rod further includes a sensing device selected from the group including a sonar transducer, a light source, a video camera, a thermometer and combinations thereof.

10. A device for anchoring a watercraft vessel at a depth less than six feet, said anchoring device comprising: an anchor bracket configured to be mountable on said watercraft vessel; a sleeve attached to said anchor bracket, said sleeve having an aperture disposed longitudinally therethrough; a sliding tube inserted through said sleeve, said sliding tube having a first end and a second end, said first end having a diameter greater than said aperture of said sleeve, and second end having a lumen disposed longitudinally at least partially therethrough, said sliding tube being configured to have a first resting position and a second deployed position; a rod having a first end disposed within said sliding tube lumen and a second end having floor contacting tip, said rod being configured to have a first resting position and a second elongated position; and a deployment means, said deployment means having a cord connected to said rod, wherein said cord is configured to move said rod and said sliding tube between said elongated position and said resting position.

11. The device for anchoring a watercraft vessel according to claim 10, wherein said sliding tube is a hollow cylindrical tube and wherein said first end of said sliding tube includes an end cap operable to limit the travel of said sliding tube through said sleeve.

12. The device for anchoring a watercraft vessel according to claim 10, wherein said bracket includes an outer bracket and an inner bracket, and wherein at least one of said inner bracket and said outer bracket being pivotable around said sleeve.

13. The device for anchoring a watercraft vessel according to claim 10, wherein said bracket further includes a guide plate operable to fasten said sleeve in a perpendicular orientation with respect to said bottom surface.

14. The device for anchoring a watercraft vessel according to claim 10, wherein said sliding tube and said rod are each not more than 5 feet in length.

15. The device for anchoring a watercraft vessel according to claim 10, wherein said bracket further includes an arcuate fastener assembly operable to fasten said sleeve in a perpendicular orientation with respect to said bottom surface.

16. The device for anchoring a watercraft vessel according to claim 10, wherein said device further includes a pulley secured to at least one of said bracket or said sleeve.

17. The device for anchoring a watercraft vessel according to claim 10, wherein said rod further includes a coupling attached to said second end of said rod operable to couple said cord.

18. The device for anchoring a watercraft vessel according to claim 10, wherein said floor contacting tip includes a rubber coating around the periphery of said floor contacting tip.

19. The device for anchoring a watercraft vessel according to claim 10, wherein said deployment means further includes an electric motor connected to said cord, said electric motor being operable to move said rod and said sliding tube between said elongated position and said resting position.

20. A method for anchoring a watercraft vessel to the bottom of a body of water, the method comprising:

(a) providing a watercraft vessel having an anchoring system, said anchoring system comprising:

(i) a bracket configured to be mountable on said watercraft vessel;

(ii) a sleeve attached to said bracket, said sleeve having an aperture disposed longitudinally therethrough;

(iii) a sliding tube inserted through said sleeve, said sliding tube having a first end and a second end, said first end having a diameter greater than said aperture of said sleeve, and second end having a lumen disposed longitudinally at least partially therethrough, said sliding tube being configured to have a first resting position and a second elongated position;

(iv) a rod having a first end disposed within said sliding tube lumen and a second end having floor contacting tip, said rod being configured to have a first resting position and a second deployed position; and (v) a deployment means, said deployment means having a deployment means selected from the group consisting of a rope, a cord, a cable, a flexible pole, a wire and combinations thereof, said deployment means connected to said rod, wherein said deployment means is configured to move said rod and said sliding tube between said elongated position and said resting position (b) making the watercraft essentially stationary on said body of water; and (c) deploying said anchoring system, wherein said sliding tube and said rod are moved into said elongated position and said floor contacting tip is at least partially embedded in said bottom.

* * * * *